US006502815B1

(12) United States Patent
Baureis et al.

(10) Patent No.: US 6,502,815 B1
(45) Date of Patent: Jan. 7, 2003

(54) LIFTING/PULL-SUCKER DRIVE MECHANISM FOR A SHEET-PROCESSING MACHINE

(75) Inventors: Martin Baureis, Horrenberg (DE); Jochen Renner, Edingen (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 7 days.

(21) Appl. No.: 09/677,429

(22) Filed: Oct. 2, 2000

(30) Foreign Application Priority Data

Oct. 1, 1999 (DE) ..... 199 47 573

(51) Int. Cl.[7] ..... B65H 5/08

(52) U.S. Cl. ..... 271/11; 271/91; 271/93; 271/107

(58) Field of Search ..... 271/10.01, 11, 271/14, 91, 93, 107

(56) References Cited

U.S. PATENT DOCUMENTS

| | | | | |
|---|---|---|---|---|
| 2,222,459 A | | 11/1940 | Backhouse | |
| 3,471,141 A | | 10/1969 | Ruetschle | |
| 3,695,606 A | * | 10/1972 | Wirz | |
| 3,938,800 A | | 2/1976 | Wirz | |
| 5,076,565 A | | 12/1991 | Liepert | |
| 5,094,439 A | * | 3/1992 | Renner et al. | 271/103 |
| 5,277,414 A | * | 1/1994 | Binnen | 271/107 |
| 5,308,055 A | * | 5/1994 | Binnen | 271/11 X |
| 5,738,347 A | * | 4/1998 | Tognino | 271/106 |
| 5,895,037 A | | 4/1999 | Baureis et al. | |
| 5,984,296 A | | 11/1999 | Fricke et al. | |

FOREIGN PATENT DOCUMENTS

| | | |
|---|---|---|
| DE | 1 144 741 | 3/1963 |
| DE | 2 132 438 | 1/1973 |
| DE | 22 20 353 C2 | 7/1973 |
| DE | 2 220 353 | 7/1973 |
| DE | 40 05 144 C2 | 8/1991 |
| DE | 195 22 901 C1 | 10/1996 |
| DE | 196 01 470 A1 | 7/1997 |
| DE | 197 28 076 A1 | 7/1998 |
| EP | 0 417 868 A1 | 3/1991 |
| GB | 1 348 738 | 3/1974 |

* cited by examiner

*Primary Examiner*—David H. Bollinger
(74) *Attorney, Agent, or Firm*—Laurence A. Greenberg; Werner H. Stemer; Ralph E. Locher

(57) ABSTRACT

A lifting/pull-sucker drive mechanism for a separating element of a sheet-processing machine, having a drivable control cam for moving at least one lifting sucker, and having a drivable control cam for moving at least one pull sucker, respectively, includes a pivotable control cam for synchronizing a lifting movement of the at least one lifting sucker and a pulling movement of the at least one pull sucker.

7 Claims, 6 Drawing Sheets

1
2
3
4
6
7
8
9
10
11
12
13
14
16
17
18
19
21
22;23
27
28

LIFTING/PULL-SUCKER DRIVE MECHANISM FOR A SHEET-PROCESSING MACHINE

BACKGROUND OF THE INVENTION

FIELD OF THE INVENTION

The invention relates to a lifting/pull-sucker drive mechanism for a sheet-processing machine, more particularly, for a separating or singling element thereof.

The published German Patent Document DE 195 22 901 C1 discloses, for example, a lifting-sucker drive mechanism wherein a suction-intake height of the lifting sucker is adjustable so that there is no change in the height at which the sheet is transferred from the lifting sucker to a downline pull or forwarding sucker. No drive or transmission for the pull-sucker movement is disclosed. Such a pull-sucker drive mechanism, however, has become known heretofore, for example, from the published German Patent Document DE 196 01 470 A1. This drive mechanism has a number of pull suckers, which execute a reciprocating translatory transporting movement through the intermediary of a cam-controlled transmission and a guide.

SUMMARY OF THE INVENTION

It is accordingly an object of the invention to provide a combined lifting/pull-sucker drive mechanism which has a compact construction.

With the foregoing and other objects in view, there is provided, in accordance with the invention, a lifting/pull-sucker drive mechanism for a separating element of a sheet-processing machine, having a drivable control cam for moving at least one lifting sucker, and having a drivable control cam for moving at least one pull sucker, respectively, comprising a pivotable control cam for synchronizing a lifting movement of the at least one lifting sucker and a pulling movement of the at least one pull sucker.

In accordance with another feature of the invention, the pivotable control cam is capable of effecting an adjustment of a transfer position at which a sheet is transferred from the lifting sucker to the pull sucker, and a transporting height of the sheet.

In accordance with a further feature of the invention, the lifting sucker is mounted so as to be controllable by the drivable control cam for moving the lifting sucker, and the pull sucker is mounted so as to be controllable by the drivable control cam for moving the pull sucker.

In accordance with an added feature of the invention, the control cams are mounted on a common shaft.

In accordance with an additional feature of the invention, the lifting sucker and the pull sucker, in a lifted position of the sheet, are disposed at an angle to a sheet pile.

In accordance with yet another feature of the invention, the lifting/pull-sucker drive mechanism include a compression spring for ensuring engagement of a control roller with the control cam for moving the lifting sucker, and of a control roller with the pivotable control cam, and including a compression spring for ensuring engagement of a control roller with the drivable control cam for moving the pull sucker, and of a control roller with the pivotable control cam.

In accordance with a concomitant feature of the invention, the pivotable control cam is formed as a segment cam.

A particular advantage afforded by the invention is that the lifting-sucker drive mechanism for the lifting sucker or suckers and the pull-sucker drive mechanism for the pull sucker or suckers have a common guide. In this way, the transfer of sheets from the lifting sucker to the pull sucker takes place at a common vertical level.

The common guide is advantageously formed as a pivotable segment cam. Due to this feature, it is possible to provide an adjustment or setting of a suction-intake height of the sheet, a height at which the sheet is transferred from the lifting sucker to the pull sucker, and a transporting height of the sheet by a single, stationary actuating or setting device.

In an advantageous configuration, sheet transfer from the lifting sucker to the pull sucker and the succeeding transportation of the sheet by the pull suckers take place with the trailing sheet edge at a slight upwardly directed angle $\alpha$. This feature makes it possible for the carrying air produced by blowing or blast devices to pass with very good effect beneath the sheet which is to be transported. The arrangement of the various control cams for the lifting movement and transporting movement, and the additional sensor or feeler cam all on a common drive shaft optimizes the compact construction of the drive mechanism according to the invention.

Provision is advantageously made for the lifting sucker to execute a translatory movement in addition to a lifting movement. This feature increases the time slot or window for the sheet transfer from the lifting sucker to the pull sucker, with the result that the quality of transfer is improved.

Thus, in general, provision is made, in a lifting/pull-sucker drive mechanism of a separating element, i.e., a suction head, of a sheet-processing machine, for the lifting suckers and pull suckers to be controlled independently of one another, and for the height adjustment of the lifting and pull sucker to be effected by a common control cam.

Other features which are considered as characteristic for the invention are set forth in the appended claims.

Although the invention is illustrated and described herein as embodied in a lifting/pull-sucker drive mechanism for a sheet-processing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
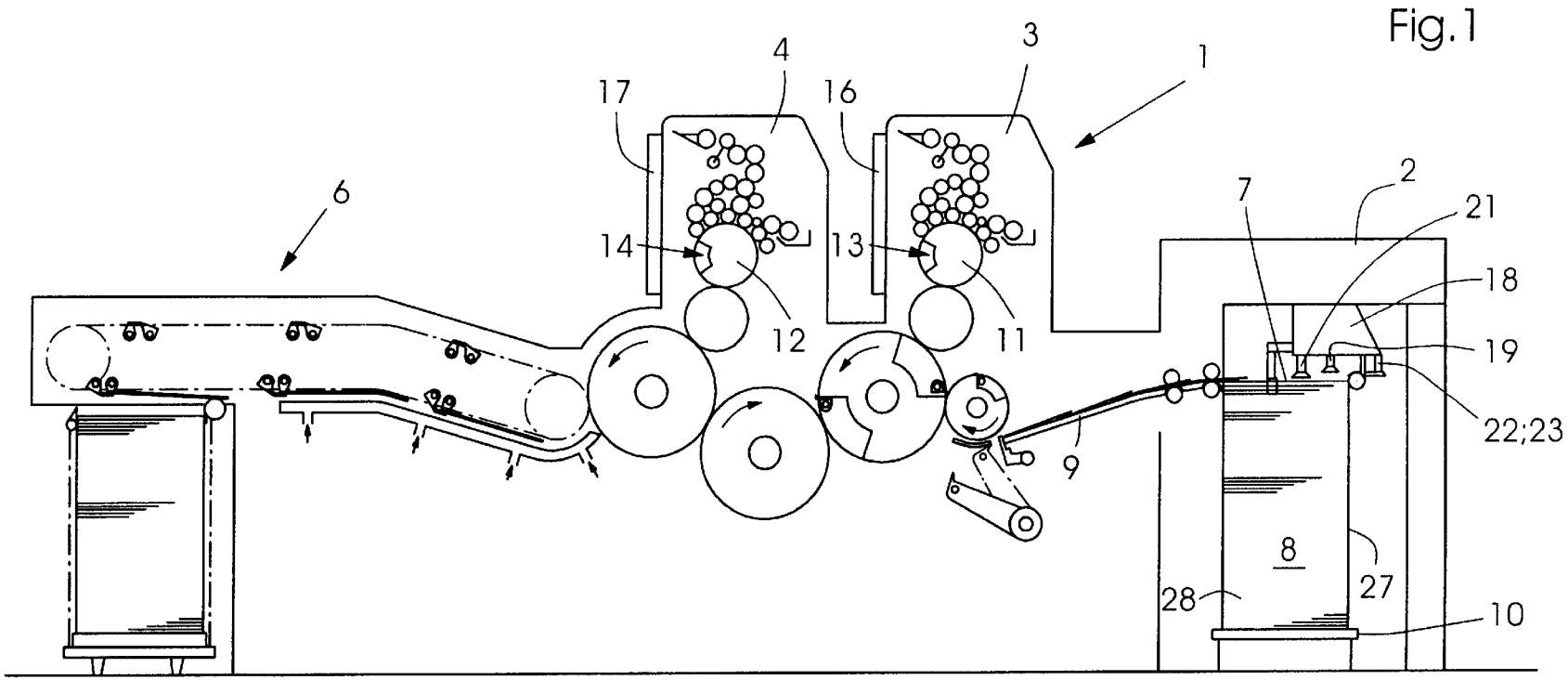
FIG. 1 is a diagrammatic side elevational view of a sheet-fed rotary printing machine incorporating the lifting/pull drive mechanism according to the invention.

Referring now to the drawings and, first, particularly to FIG. 1 thereof, there is shown therein a rotary printing machine, e.g. a printing machine 1 which processes sheets 7, having a feeder 2, at least one printing unit 3 or 4 and a delivery 6. The sheets 7 are removed from a sheet pile 8 and fed to the printing units 3 and 4, via a feed table 9, separately, i.e., singly, or in imbricate form. Each of the printing units 3 and 4 includes, in a conventional manner, a form or plate cylinder 11, 12. The form or plate cylinders 11 and 12, respectively, have a device 13, 14 for fastening flexible printing forms or plates thereon. Furthermore, each form or plate cylinder 11, 12 has a respective device 16, 17 assigned thereto for changing printing forms or plates semi-automatically or fully automatically.

The sheet pile 8 lies on a controllably liftable stacking plate 10. The sheets 7 are removed from the upper s,ide of the sheet pile 8 by a so-called suction head 18, which has, among other elements, a number of lifting suckers 19 and pull suckers 21 for separating the sheets 7. Also provided are blowing or blast devices 22 for loosening the upper sheet layers, and sensor or feeler elements 23 for adjusting the sheet pile. For aligning the sheet pile 8, in particular the top sheets 7 of the sheet pile 8, a number of lateral and rear stops are provided.

Figure 2:
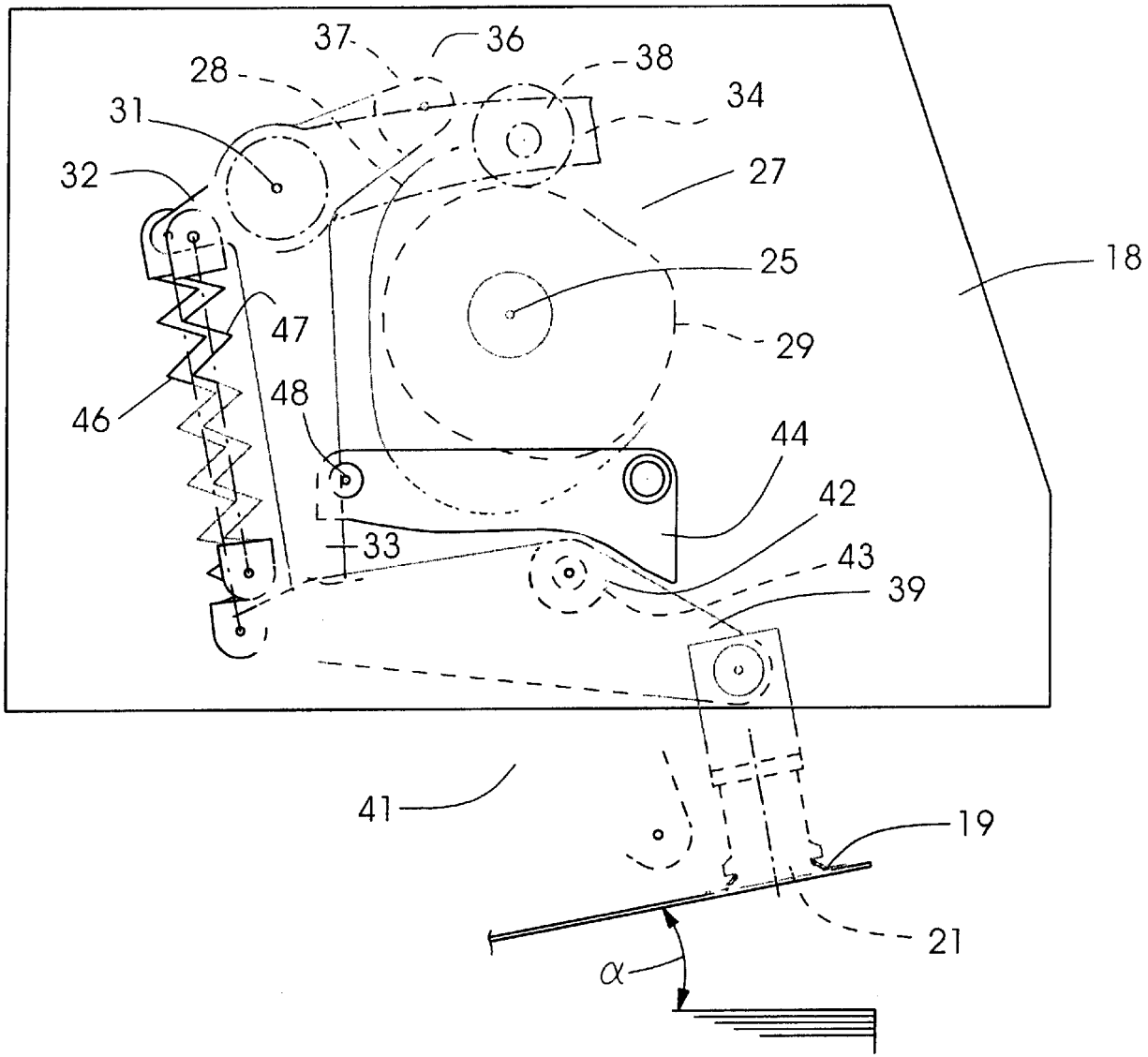
FIG. 2 is an enlarged fragmentary view of FIG. 1 diagrammatically showing the lifting/pull-sucker drive mechanism according to the invention at a point in time at which a sheet is transferred from a lifting sucker to a pull sucker.
Figure 8:
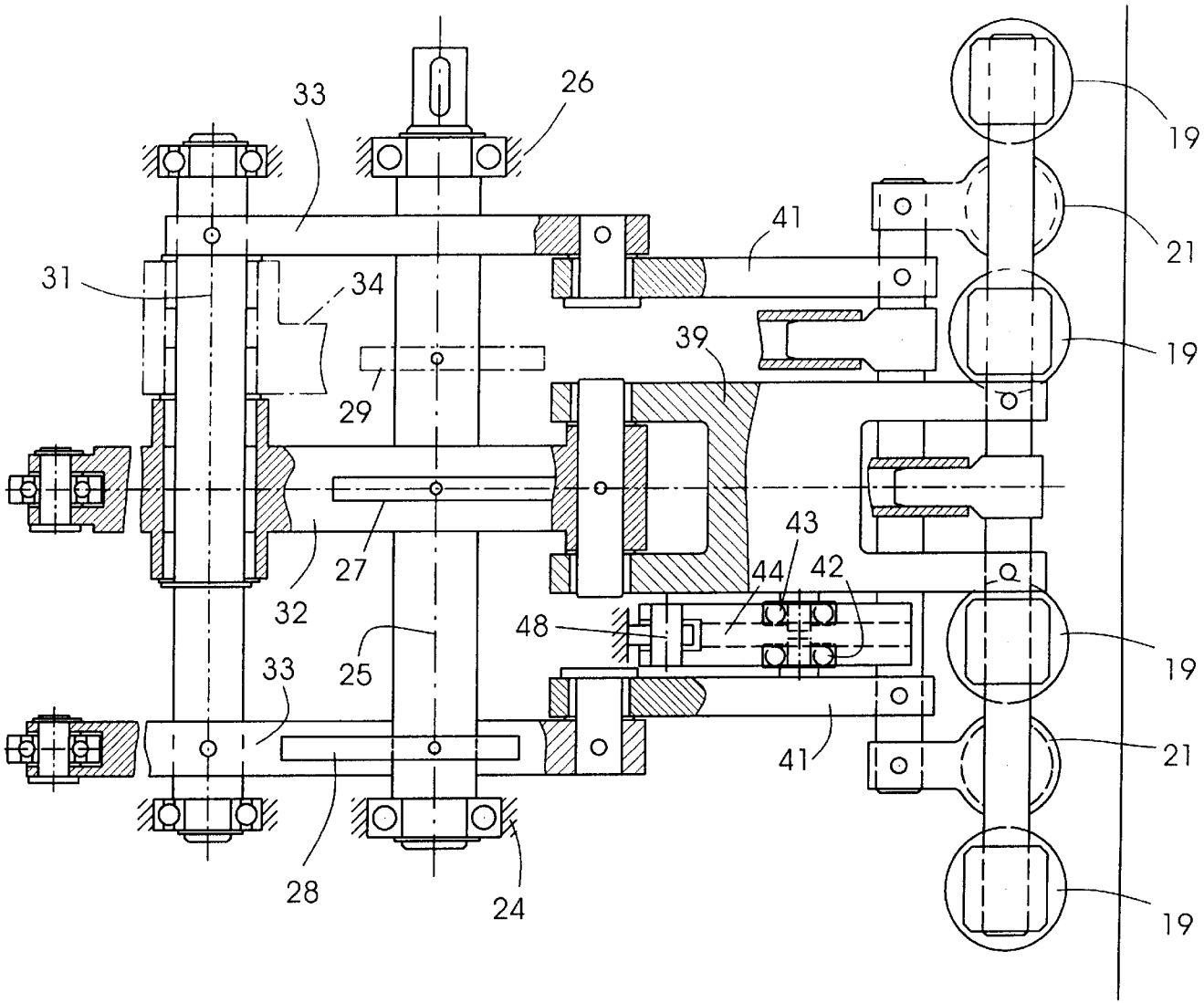
FIG. 8 is a plan view, partly broken away and in section, of the sucker drive mechanism.

As shown in FIG. 2, for example, the suction head 18 has a drive shaft 25 which is mounted in framework walls 24 and 26 (note FIG. 8) of the suction head 18 so that it can be driven. Driving can be effected either by way of the machine per se or by way of a separately controlled electric motor.

The drive shaft 25 bears a first control cam 27 for moving the lifting sucker 19, a second control cam 28 for moving the pull sucker 21, and a third control cam 29 for moving the sensor or feeler element 23, which controls the pile adjustment.

A rotary shaft 31, which is likewise mounted in the framework walls 24 and 26 of the suction head 18, parallel to the drive shaft 25, carries, adjacent to one another, a first rotatably mounted link or rocker arm 32 for moving the lifting sucker 19, a second rotatably mounted link or rocker arm 33 for moving the pull sucker 21 and a third rotatably mounted link or rocker arm 34 for moving the sensor or feeler element 23.

One arm of each link 32, 33, 34, respectively, bears a rotatably mounted control roller 36, 37, 38 which cooperates with the respective control cam 27, 28, 29.

The link 32, at the end of the second arm thereof, is articulatedly connected to a lifting-sucker carrier 39 which, in turn, bears the lifting sucker 19. The link 33, at the end of the second arm thereof, is connected to a pull-sucker carrier 41 which, in turn, articulatedly bears the pull-sucker 21.

The lifting-sucker carrier 39 has a rotatably mounted control roller 42, and the pull-sucker carrier 41 has a rotatably mounted control roller 43, the rollers 42 and 43 being in joint rolling contact with a pivotably arranged segment cam 44.

A compression spring 46 between the lifting-sucker carrier 39 and the link 32 ensures the engagement of the control roller 36 with the control cam 27, and of the control roller 42 with the segment cam 44.

A compression spring 47 between the pull-sucker carrier 41 and the link 33 ensures the engagement of the control roller 37 with the control cam 28, and of the control roller 43 with the segment cam 44.

The segment cam 44 is mounted so as to be pivotable about a framework-mounted shaft 48 of the suction head 18 by a suitable non-illustrated actuating device.

Figure 5:
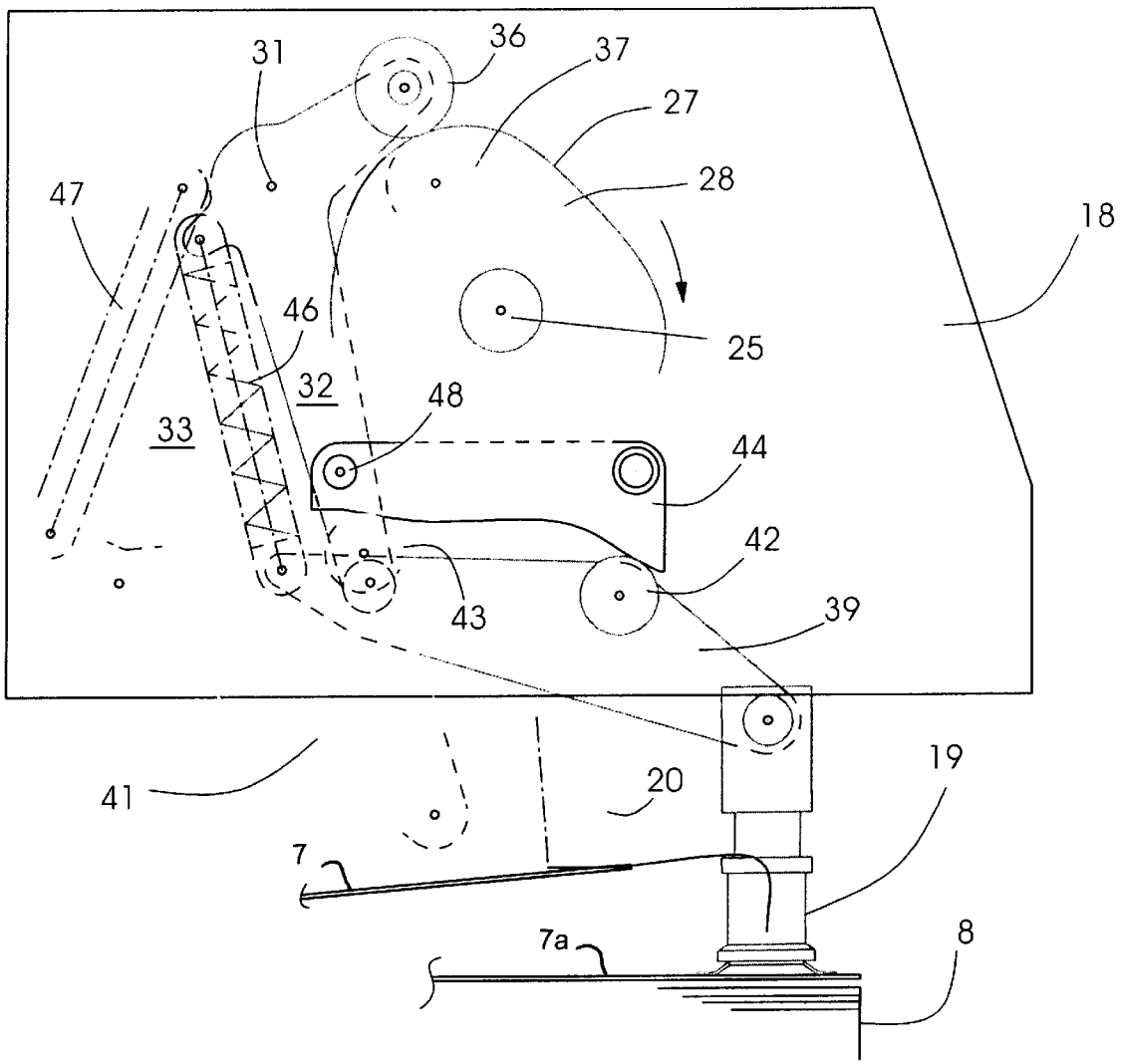
FIG. 5 is a further view like that of FIG. 2 showing the lifting/pull-sucker drive mechanism at a suction-intake point of the lifting sucker and at a point of reversal of the pull sucker.
Figure 6:
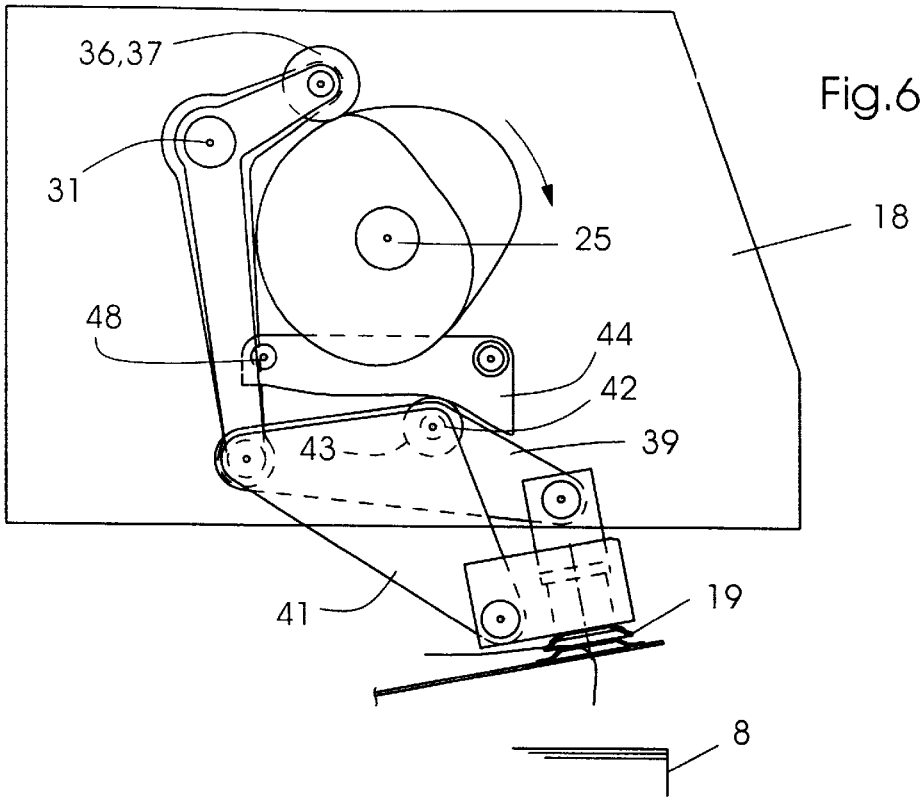
FIG. 6 is yet another view like that of FIG. 2, reduced in size and showing the lifting/pull-sucker drive mechanism shortly before the lifting sucker reaches the transfer point.
Figure 7:
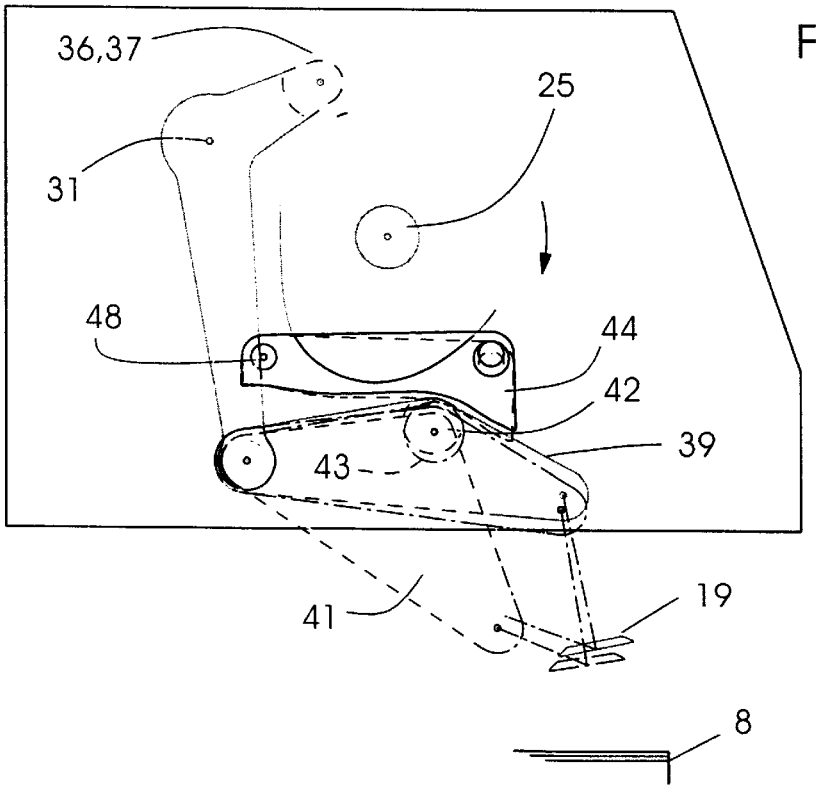
FIG. 7 is yet a further view like that of FIG. 2, diagrammatically illustrating drawing an adjustment of the suction-intake height.

As is illustrated in FIG. 5, the lifting sucker 19 is positioned on the sheet pile 8 for gripping the sheet 7 by suction and picking it up. At this point in time, the pull sucker 21 is located at the turning point thereof at the end of the pulling movement. Once the sheet 7 has been gripped by suction, it is lifted off the sheet pile 8 and, as is illustrated in FIG. 6, brought into a transfer position. This transfer position is adjustable in height relative to the sheet pile 8. In this case, the lifting sucker 19, which was aligned parallel to the top layer of the sheet pile 8 during the suction-gripping or attachment phase, is pivoted, as shown in FIG. 2, over a small angle $\alpha$ ($\alpha$=approximately 10° to 35°) relative to the top layer of the sheet pile 8. Due to this feature, the trailing edge of the sheet 7 which is to be transported is raised somewhat, with the result that a carrying-air flow can be built up beneath the sheet 7 by the blowing or blast devices 22 which are provided.

FIG. 2 illustrates the transfer position wherein the pull sucker 21 is positioned on the sheet 7. In this regard, the pull sucker 21 is likewise inclined at an angle $\alpha$ relative to the top layer of the sheet pile 8.

Starting from the transfer position, the lifting sucker 19 and the pull sucker 21 then execute a joint transporting movement. In this regard, the control roller 42 of the lifting-sucker carrier 39, and the control roller 43 of the pull-sucker carrier 41 roll on the common segment cam 44.

Figure 3:
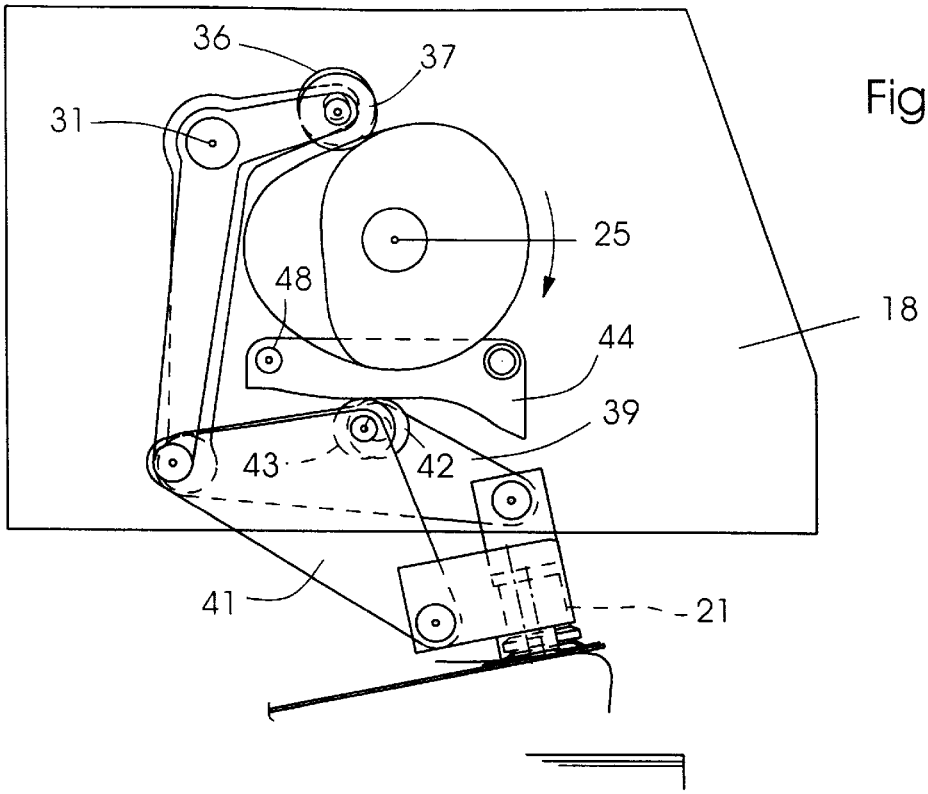
FIG. 3 is a view like that of FIG. 2, reduced in size and showing the lifting/pull-sucker drive mechanism at an end of the transporting path of the lifting sucker.
Figure 4:
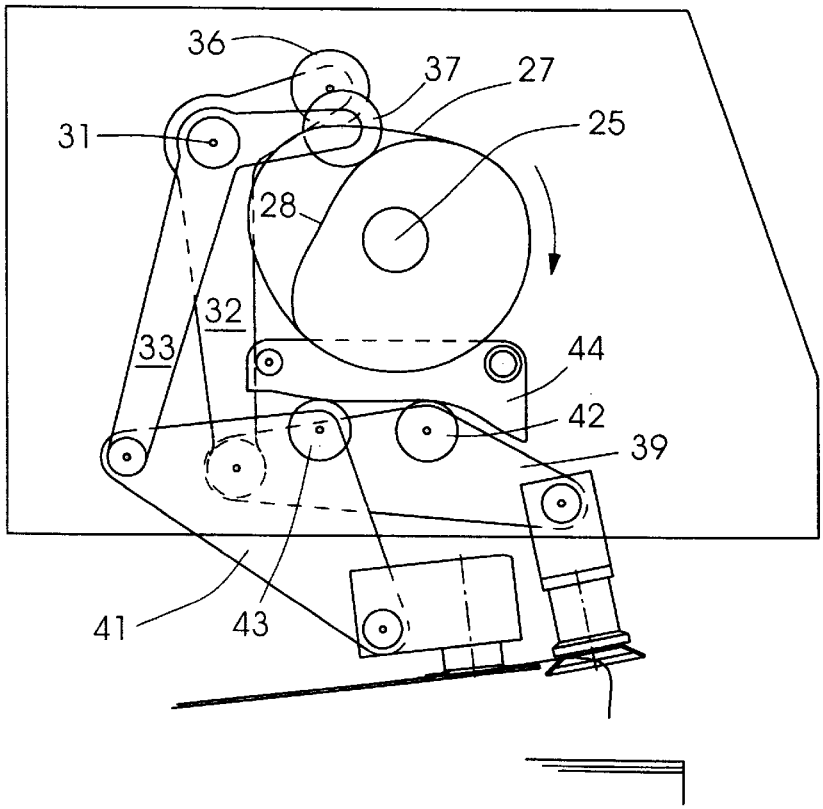
FIG. 4 is another view like that of FIG. 2, reduced in size and showing the lifting/pull-sucker drive mechanism at a point in time during a rearward movement of the lifting sucker and a forward movement of the pull sucker.

The resulting relatively large time slot or window is utilized for correct sheet transfer. Following this common transport path, the pull sucker 21 begins the forward movement thereof, as is illustrated in FIG. 3. Once the trailing edge of the sheet 7 has fully passed the lifting sucker 19, the latter is positioned on the sheet pile 8 in order to attach or grip the next sheet 7*a* by suction.

We claim:

1. A lifting/pull-sucker drive mechanism for a separating element of a sheet-processing machine, comprising:

at least one lifting sucker;

at least one pull sucker;

a drivable control cam for moving said at least one lifting sucker;

a drivable control cam for moving said at least one pull sucker; and a pivotable control cam for synchronizing a lifting movement of said at least one lifting sucker and a pulling movement of said at least one pull sucker.

2. The lifting/pull-sucker drive mechanism according to claim 1, wherein said pivotable control cam is capable of effecting an adjustment of a transfer position at which a sheet is transferred from the lifting sucker to the pull sucker, and of a transporting height of the sheet.

3. The lifting/pull-sucker drive mechanism according to claim 1, wherein the lifting sucker is mounted so as to be controllable by the drivable control cam for moving the lifting sucker, and the pull sucker is mounted so as to be controllable by the drivable control cam for moving the pull sucker.

4. The lifting/pull-sucker drive mechanism according to claim 3, wherein said drivable control cams are mounted on a common shaft.

5. The lifting/pull-sucker drive mechanism according to claim 1, wherein the lifting sucker and the pull sucker, in a lifted position of the sheet, are disposed at an angle to a sheet pile.

6. The lifting/pull-sucker drive mechanism according to claim 1, including a compression spring for ensuring engagement of a control roller with the control cam for moving the lifting sucker, and of a control roller with said pivotable control cam, and including a compression spring for ensuring engagement of a control roller with the drivable control cam for moving the pull sucker, and of a control roller with said pivotable control cam.

7. The lifting/pull-sucker drive mechanism according to claim 1, wherein said pivotable control cam is formed as a segment cam.

* * * * *